US005163592A

United States Patent [19]

Newton et al.

[11] Patent Number: 5,163,592

[45] Date of Patent: Nov. 17, 1992

[54] PIVOTING KNIFE SHEATH

[76] Inventors: Thomas D. Newton, 136 ½ West 2nd, Sparks, Nev. 89501; Harold L. Hull, 401 Canyon Way #43, Sparks, Nev. 89434

[21] Appl. No.: 586,298

[22] Filed: Sep. 21, 1990

[51] Int. Cl.[5] ..... B26B 29/02

[52] U.S. Cl. ..... 224/197; 224/232; 224/242; 224/246; 224/253; 224/904; 30/151; 30/296.1

[58] Field of Search ..... 224/197, 196-200, 224/232, 233, 253, 226, 904, 242, 246, 243, 245; 30/151, 143, 162-164, 296.1, 298.4, 320, 321; 248/37.3, 37.6

[56] References Cited

U.S. PATENT DOCUMENTS

| | | | |
|---|---|---|---|
| 580,634 | 4/1897 | Bannerman et al. | 224/232 |
| 660,302 | 10/1900 | Lowman | 224/233 |
| 1,500,643 | 7/1924 | Scalbom | 30/321 |
| 2,387,900 | 10/1945 | Hartwell | 224/197 |
| 2,527,710 | 10/1950 | Davidson, Jr. | 30/151 |
| 2,793,434 | 5/1957 | Wiginton | 224/232 X |
| 2,859,516 | 11/1958 | McQuery | 224/232 X |
| 3,107,833 | 10/1963 | Vaughn | 224/197 |
| 3,524,570 | 9/1968 | Seguine | 30/151 |
| 4,114,787 | 9/1978 | Raimer | 224/2 D |
| 4,211,003 | 7/1980 | Collins | 30/162 |
| 4,404,747 | 9/1983 | Collins | 30/151 |
| 4,414,744 | 11/1983 | Collins | 30/151 |
| 4,523,379 | 6/1985 | Osterhout | 30/151 |
| 4,558,516 | 12/1985 | Collins | 30/151 |
| 4,726,498 | 2/1988 | Esposito | 224/232 |
| 4,759,483 | 7/1988 | Willoughby | 224/253 |
| 4,835,863 | 6/1989 | Salandre | 30/143 |
| 4,856,192 | 8/1989 | Collins | 30/151 |
| 5,002,213 | 3/1991 | Newton et al. | 224/232 |
| 5,031,810 | 7/1991 | Finn et al. | 224/232 X |

FOREIGN PATENT DOCUMENTS

| | | | |
|---|---|---|---|
| 0181377 | 11/1962 | Sweden | 224/232 |

*Primary Examiner*—Henry J. Recla
*Assistant Examiner*—Casey Jacyna

[57] ABSTRACT

A knife and sheath combination including a pivotable mount, whereby, the sheath when empty hangs from the belt with its knife opening facing upward, however, when the knife is inserted into the sheath, the weight of the knife handle causes the sheath to revolve on its mount to a position wherein the knife opening faces downward. This arrangement allows the user to quick-draw the knife with a downward motion but may re-sheath the knife from the top position.

5 Claims, 1 Drawing Sheet

PIVOTING KNIFE SHEATH

BACKGROUND OF THE INVENTION

This invention relates to improvements in sheaths for knives and the like and more particularly to a knife sheath incorporating improved means for pivoting the sheath by the weight of the knife handle.

While there are many conventional sheaths such as those described in U.S Pat. Nos. 4,211,003, 4,726,498, or 4,856,192 and including the pending patent application Ser. No. 07/468,886 for "HARNESS KNIFE QUICK RELEASE" by the present co-inventors, none of these conventional sheaths are suitable for holding, protecting and securing a knife therein while allowing a quick-release in an inverted position and yet allow the sheath to swivel to an upright position for convenient re-insertion of the knife.

SUMMARY OF THE INVENTION

It is therefore a primary object to provide a sheath for a knife which holds, protects and secures a knife therein with mounting means which allow the sheath and knife to swivel.

It is a further object to provide a sheath for a knife having its swivel mounting means located at a point whereby the weight of the sheath when empty positions the sheath with its opening in a generally upward first position, but when the knife is inserted into the sheath, the weight of the knife handle overcomes the weight of the sheath and the knife and sheath revolve to a generally downward second position which positions the knife in an inverted position for quick release.

It is a further object to provide a sheath which may be mounted on a strap in an inverted position as taught by co-pending application Ser. No. 07/468,886 filed by the present co-inventors or mounted on a belt as taught by the present invention.

Yet another object is to provide means in the mounting strap for insertion over a button to secure the sheath to a garment or the like.

Other objects and advantages will become obvious when taken into consideration with the following descriptions and drawings.

DETAILED DESCRIPTION OF THE DRAWINGS

Figure 1:
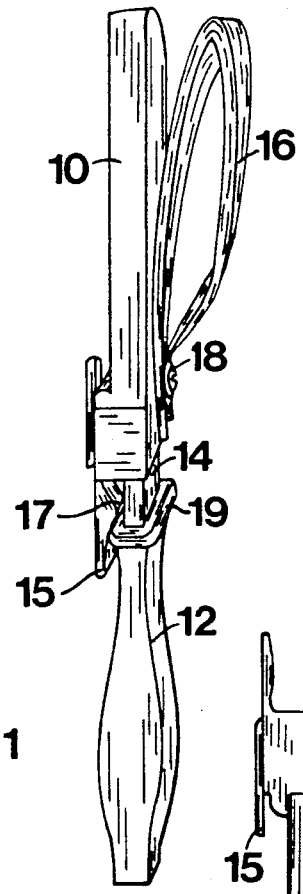
FIG. 1 is a perspective view of the present invention showing a knife being inserted into the sheath but being in an unlocked position.

Referring now in detail to the drawings wherein like numerals, refer to like parts, 10 is a sheath while 12 is a knife handle with knife blade 14, 15 being a structure cooperating with the hub of the knife handle 12 to provide a means to normally positively lock knife 12 and sheath 10 together, 16 being a mounting strap of suitable size to surround and capture a belt, 18 being a bolt which screws into the casing of sheath 10 (not shown) while 20 are washers which capture mounting strap 16 in a loose fit to allow strap 16 to easily swivel on bolt 18, while 22 is an opening or slit in mounting strap 16 of a suitable size to fit over a button on a garment (not shown) while 24 is a mounting hole which may be used to additionally mount the sheath in a permanent inverted position on a shoulder strap (not shown) and 26 being a belt.

Figure 2:
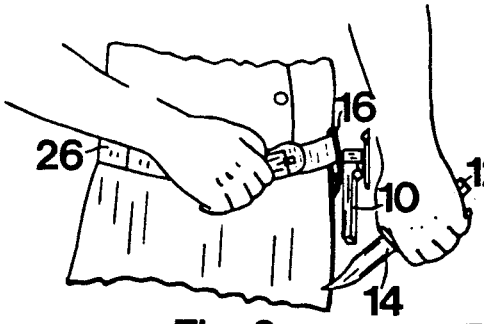
FIG. 2 is a plan view showing the knife removed and the sheath in a generally upward first position to receive the knife from above.
Figure 3:
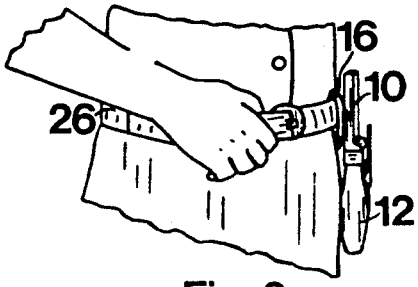
FIG. 3 is a plan view showing the knife inserted into the sheath with the knife and sheath now in a generally downward second position.
Figure 4:
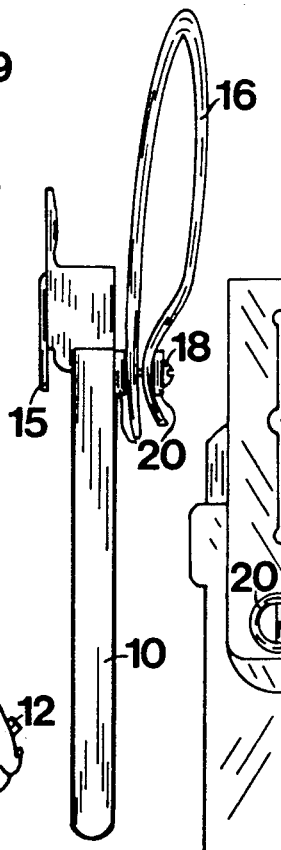
FIG. 4 is an edge view of the empty sheath with the opening facing the top.
Figure 5:
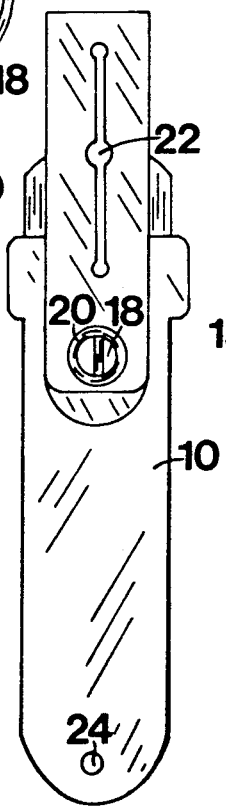
FIG. 5 is a side view of the sheath.
Figure 6:
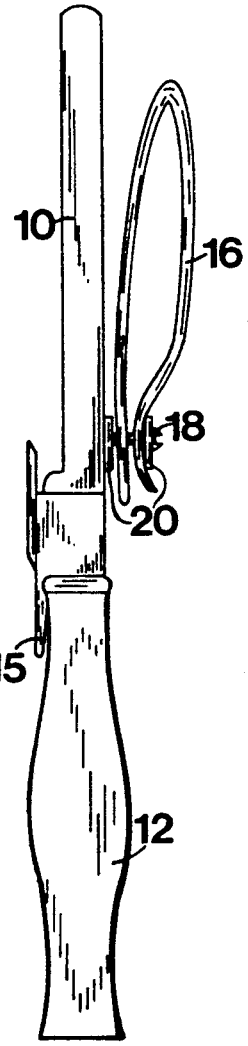
FIG. 6 is an edge view of the knife and sheath with the opening facing the bottom and the knife in a locked position.

It will now be seen that when the mounting strap is suitably secured to a belt such as shown at 26 in FIG. 2 and 3, that when the knife is in the sheath, that the knife and sheath hang from the belt in its second position ready for quick release by a generally downward movement of the hand and arm, however, when the knife is removed, the sheath revolves on its mounting bolt to its first position ready to receive the knife from the top which is easier for the user than trying to insert the knife into a fixed sheath from the bottom. Now, when the knife is released by the user, the knife and sheath once again swivel into its second position, such action being caused by the weight of the knife handle being greater than that of the sheath and is now once again ready to be withdrawn from the bottom.

It will also be seen that we have provided an additional mounting means in the form of a button-hole which may be used to secure the mounting strap to a button on a suitable garment (not shown).

It will also be noted that we have provided an additional mounting hole in the sheath for mounting the sheath in a permanent inverted position on a strap such as a harness (not shown).

The invention has been shown and described in preferred form and by way of example only and different variations and modifications can be made within the spirit of the invention. The invention, therefore is not intended to be limited to any particular form or embodiment except in so far as such limitations are expressly set forth in the claims.

What we claim and wish to secure by Letters Patent is;

1. A combination knife and sheath comprising; a knife having a blade and a handle, said handle having a hub, said sheath having an open end to receive said knife blade, a mounting strap, means to normally positively lock said knife and said sheath together, means to pivotably mount said sheath to said mounting strap, said pivotable mount being at a point substantially at said open end of said sheath, wherein said means to pivotally mount said sheath is located so that when said sheath is empty, said sheath will hang in a vertical position with its said open end in an upward position, due to the gravity of it's own weight and, when said sheath contains said knife, said sheath will hang in an opposite vertical position with it's said open end in a downward position due to the gravity of the weight of said knife and handle.

2. The device of claim 1 in which said mounting strap includes a loop capable of capturing and surrounding a belt.

3. The device of claim 1 in which said means to pivotably mount said sheath to said mounting strap is a bolt and washer securing said mounting strap to said sheath in a loose fitting relationship whereby, said sheath is free to rotate freely on said bolt.

4. The device of claim 1 in which said mounting strap contains a button-hole.

5. The device of claim 1 including a mounting hole in said sheath at its distal end for mounting said sheath in a permanent inverted position on a shoulder strap.

* * * * *